US005308175A

United States Patent [19]

Ito

[11] Patent Number: 5,308,175

[45] Date of Patent: May 3, 1994

[54] PRINTER WITH REVERSE SHEET FEED PATH TO SHEET INLET

[75] Inventor: Noritsugu Ito, Chita, Japan

[73] Assignee: Brother Kogyo Kabushiki Kaisha, Nagoya, Japan

[21] Appl. No.: 87,272

[22] Filed: Jul. 8, 1993

[30] Foreign Application Priority Data

Aug. 20, 1992 [JP] Japan ..... 4-221288

[51] Int. Cl.[5] ..... B41J 11/50

[52] U.S. Cl. ..... 400/605; 400/611; 400/625; 400/608.3; 271/184; 271/225; 271/227; 271/233; 271/902

[58] Field of Search ..... 400/605, 608.3, 611, 400/625; 271/225, 227, 265, 233, 184, 902, 9

[56] References Cited

U.S. PATENT DOCUMENTS

| | | | |
|---|---|---|---|
| 4,229,113 | 10/1980 | Anderson et al. | 400/605 |
| 4,234,261 | 11/1980 | Hendrischk et al. | 400/608.3 |
| 4,619,197 | 10/1986 | Miller | 400/625 |
| 4,761,001 | 8/1988 | Hayakawa et al. | 271/902 |
| 4,898,488 | 2/1990 | Yokoi et al. | 400/605 |
| 4,988,226 | 1/1991 | Ito | 400/605 |
| 4,995,745 | 2/1991 | Yokoi et al. | 400/605 |
| 5,059,049 | 10/1991 | Rosenthal | 400/605 |
| 5,171,006 | 12/1992 | Naito | 271/9 |
| 5,177,547 | 1/1993 | Kanemitsu et al. | 271/902 |

FOREIGN PATENT DOCUMENTS

| | | | |
|---|---|---|---|
| 62-80072 | 4/1987 | Japan | 400/607 |

*Primary Examiner*—Eugene H. Eickholt
*Attorney, Agent, or Firm*—Oliff & Berridge

[57] ABSTRACT

In this printer, switching between a single-sheet form feed path and a continuous form feed path occurs by rotating a paper guide when feeding the forms. When the printed single-sheet form is to be discharged onto a table, the tail end of the form is detected by a first single-sheet form sensor. Form feed is stopped for a moment, and the paper guide is rotated toward the continuous form feed path. Reverse feed of the form is resumed and continued until the tail end of the form reaches approximate center of the paper guide. The paper guide is then rotated toward the single-sheet form feed path. The tail end of the form is bent toward the table, and the form is discharged onto the table. As a result, single-sheet forms fed from a manual insertion port or from an automatic paper sheet feeder can be conveyed after finishing printing to the position where the forms are inserted in a stabilized manner without causing the forms to jam on the discharge path.

26 Claims, 17 Drawing Sheets

Fig.11B

| ITEM | INSTRUCTIONS |
|---|---|
| S11 | TURN PAPER GUIDE 71 TO POSITION IN FIG.5 |
| S12 | FORM PRESENT AT 2ND SINGLE-SHEET FORM SENSOR 88? |
| S13 | FEED FORM TO PRINT AREA |
| S14 | PRINT |
| S15 | DISCHARGE COMMAND CAME? |
| S16 | FORM PRESENT AT 1ST SINGLE-SHEET FORM SENSOR 90? |
| S17 | START REVERSE FORM FEED |
| S18 | FORM PRESENT AT 1ST SINGLE-SHEET FORM SENSOR 90? |
| S19 | STOP FORM FEED |
| S20 | TURN PAPER GUIDE 71 TO POSITION IN FIG.6 |
| S21 | FEED FORM REVERSE BY N1 PULSE |
| S22 | TURN PAPER GUIDE 71 TO POSITION IN FIG.5 |
| S23 | FEED FORM REVERSE |
| S24 | FORM PRESENT AT 1ST SINGLE-SHEET FORM SENSOR 90? |
| S25 | FEED FORM REVERSE BY N2 PULSE |

Fig.13B

| ITEM | INSTRUCTIONS |
|---|---|
| S41 | TURN PAPER GUIDE 71 UP TO POSITION IN FIG.6 |
| S42 | FEED FORM NORMAL BY N3 PULSE |
| S43 | FORM PRESENT AT 2ND SINGLE-SHEET FORM SENSOR 88? |
| S44 | ERROR CORRECTION |
| S45 | TURN PAPER GUIDE 71 UP TO POSITION IN FIG.5 |
| S46 | FEED FORM TO PRINT AREA |
| S47 | PRINT |
| S48 | DISCHARGE COMMAND CAME? |
| S49 | FORM PRESENT AT 1ST SINGLE-SHEET FORM SENSOR 90? |
| S50 | START FORM REVERSE FEED |
| S51 | FORM PRESENT AT 1ST SINGLE-SHEET FORM SENSOR 90? |
| S52 | STOP REVERSE FORM FEED |
| S53 | TURN PAPER GUIDE 71 UP TO POSITION IN FIG.6 |
| S54 | FEED FORM REVERSE BY N1 PULSE |
| S55 | TURN PAPER GUIDE 71 UP TO POSITION IN FIG.5 |
| S56 | FEED FORM REVERSE |
| S57 | FORM PRESENT AT 1ST SINGLE-SHEET FORM SENSOR 90? |
| S58 | FEED FORM REVERSE BY N2 PULSE |

PRINTER WITH REVERSE SHEET FEED PATH TO SHEET INLET

BACKGROUND OF THE INVENTION

1. Field of the Invention

The present invention relates to a printer capable of printing on either single-sheet forms or a continuous form. More specifically, the invention relates to a printer capable of discharging the printed single-sheet forms to a position where the single-sheet forms are inserted.

2. Description of Related Art

Printers capable of printing either on single-sheet forms or a continuous form are known as described in Japanese patent application No. 3-286670. As shown in FIG. 15, this printer comprises a printing area; feed and pinch rolls 110A, 110B and 112A, 112B; a table 104; paper guides 114, 116, and 118; a continuous form feed mechanism 120; and a paper guide 102. FIG. 15 shows major components only, omitting the casing and other known parts.

The printing area comprises a printing head 108 for printing on paper sheets and a platen 106. The feed and pinch rolls 110A, 110B and 112A, 112B are rotatably arranged to feed single-sheet forms to the printing area. The table 104 is designed for single-sheet forms to be placed thereon so that the single-sheet forms can be inserted into the printer. The paper guides 114, 116, and 118 guide paper sheet forms for printing to the printing area.

The continuous form feed mechanism 120 comprises a pin tractor feeder of a well-known type for feeding the continuous form to the printing area. The paper guide 102 is arranged for swinging in the directions of arrows X and Y, as shown in the drawing, to switch the paper sheet feed path to either one of two feed paths, a single-sheet form feed path and a continuous form feed path. Therefore, when printing is to be made on the continuous form, the paper guide 102 is swung in the Y direction so that the continuous form is fed by the continuous form feed mechanism 120 to the printing area. When printing is to be made on single-sheet forms, the paper guide 102 is swung in the X direction so that the single-sheet forms are fed from the table 104 or an automatic paper sheet feeder to the printing area. The printed single-sheet forms are selectively discharged onto the table 104. Namely, the printed single-sheet forms are conveyed by the feed and pinch rolls 110A, 110B and 112A, 112B, according to the instructions of an operator, in the direction opposite the feed direction. They are guided between the paper guides 102 and 114, between the paper guides 114 and 116, and discharged onto the table 104.

In the type of conventional printers described above, however, the path for discharging the single-sheet forms onto the table 104 is not straight but curved to some extent in the vicinity of the paper guide 102. This is because the same path is also used as the path for the continuous form. As a result, paper jamming occurs. When a plural number of top-end bound paper forms are inserted from the table 104, and discharged after printing to the table 104, the bottom unbound ends of the forms might jam if they are obstructed or caught by the paper guide 102 located in the X-position.

It is therefore an object of the present invention to provide a printer capable of conveying paper sheets after printing back to the inserted position. They are conveyed in a stabilized manner without causing paper jamming along the reverse conveying path for discharge even when the printing is made on duplication slips.

SUMMARY OF THE INVENTION

To achieve the above and other objects, a printer capable of printing on both single-sheet forms and a continuous form is provided. The printer is capable of discharging the printed single-sheet forms back to their inserted position and comprises a single-sheet form feed path for feeding the single-sheet forms to a printing area and a continuous form feed path for feeding a continuous form to the printing area. A path switching means is disposed in the vicinity of the joining point of the single-sheet form feed path and the continuous form feed path. The switching means is movable between a first position forming part of the single-sheet form feed path, a second position forming part of the automatic single-sheet form feed path, and a third position forming part of the continuous form feed path. Control means is provided for controlling, when discharging the single-sheet forms, the conveyance of the single-sheet forms toward a path switching member by a specified amount where the feed path switching member is located in the second position. The control means is also provided to move the path switching member when the tail end of the single-sheet form comes on the path switching member to the first position to guide the tail end of the single-sheet forms toward the single-sheet form feed path.

In accordance with the present invention, when the paper sheets are to be fed, the feed path switching member is moved to either the first, second or third positions to form one of the paths for the single-sheet forms or the continuous form. When the printed single-sheet forms are to be discharged back to their inserted position, the control means starts a reverse feed of the form when the path switching member is first moved to its second position. When the bottom end of the form reaches the top surface of the path switching member, the control means moves the path switching member to the first position so that the bottom end of the form is bent toward the path on the downstream side of the printing area. Then, the form is discharged back to the inserted position.

BRIEF DESCRIPTION OF THE DRAWINGS

A preferred embodiment of the present invention will be described below in detail with reference to the following figures wherein:

FIG. 11B is a table listing the steps of the flowchart of FIG. 11A;

FIG. 13B is a table listing the steps of the flowchart of FIG. 13A;

DETAILED DESCRIPTION OF PREFERRED EMBODIMENTS

Figure 2:
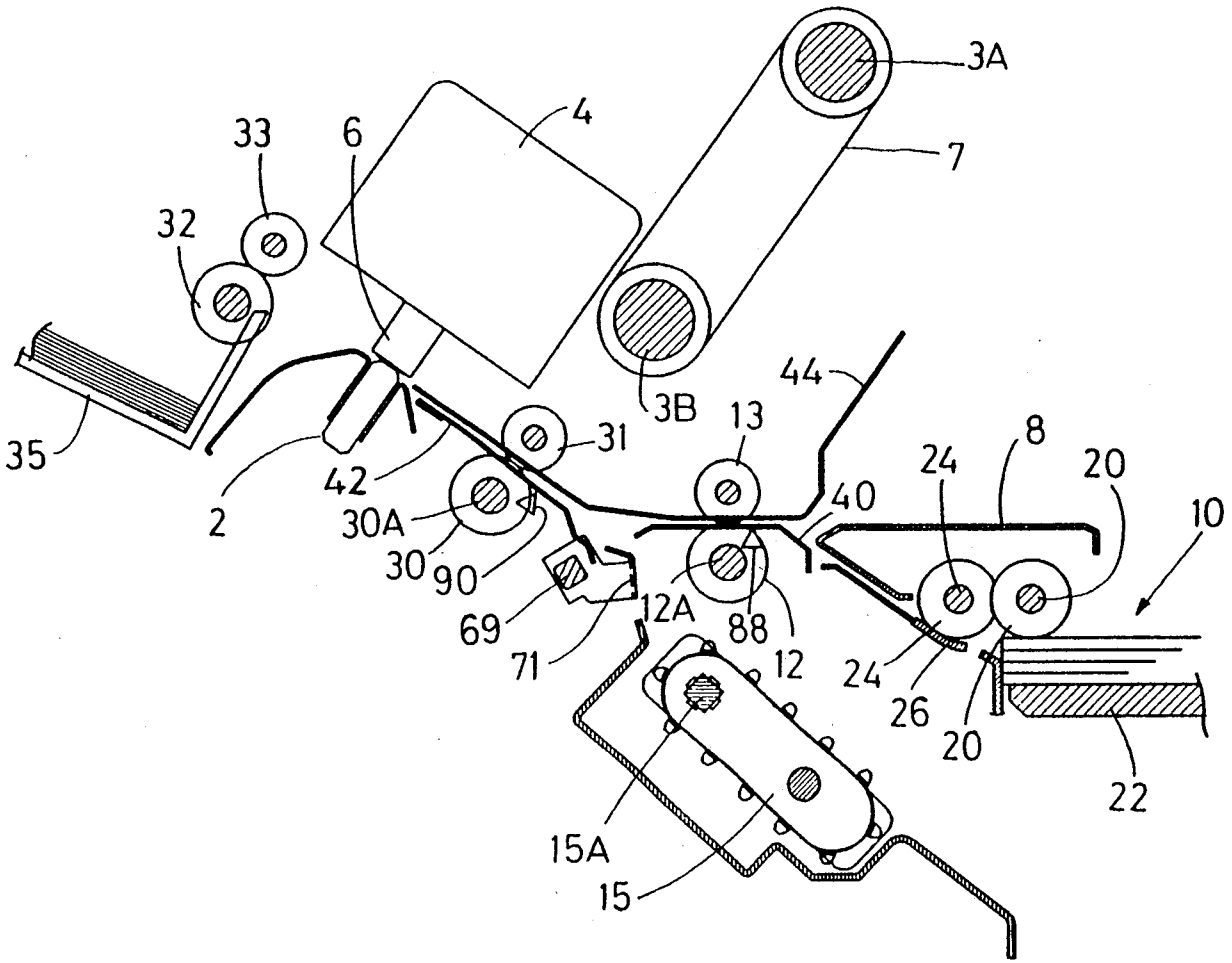
FIG. 2 is a schematic cross-sectional view of the paper sheet feed paths within the printer.
Figure 3:
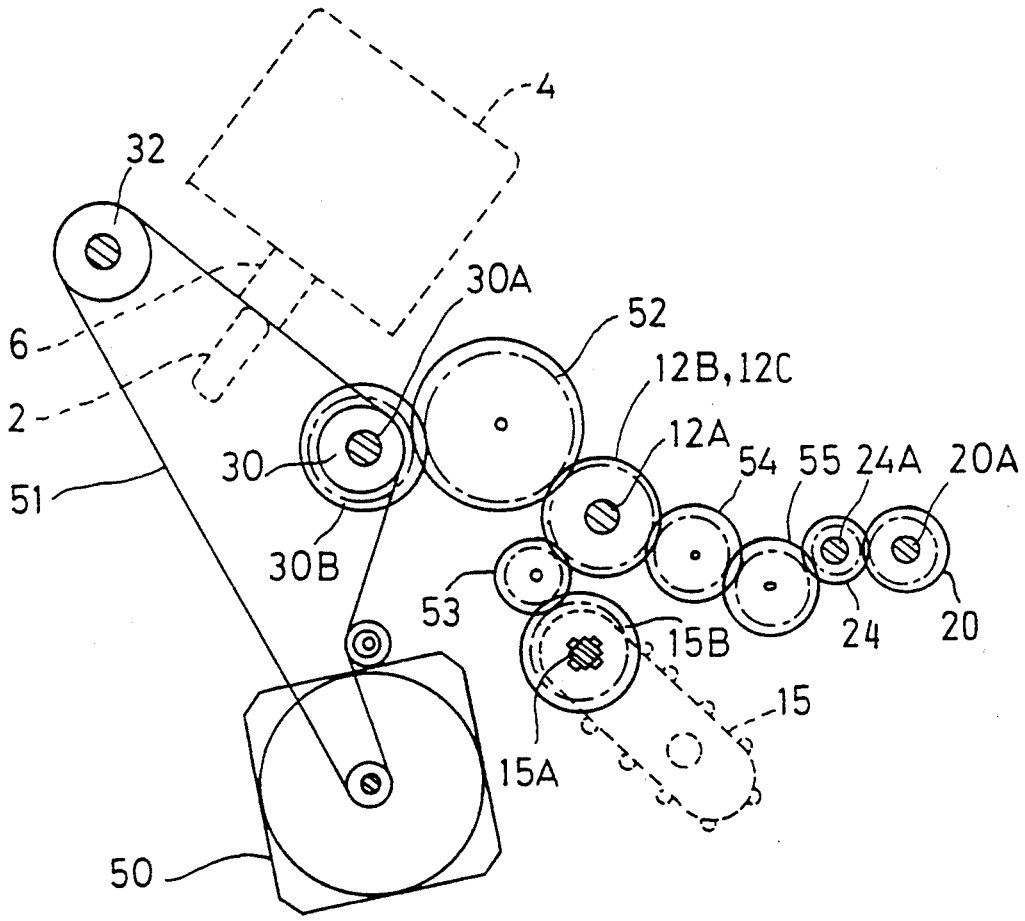
FIG. 3 is a view showing the drive system for conveying the single-sheet forms and continuous form fed from the front of the printer.
Figure 4:
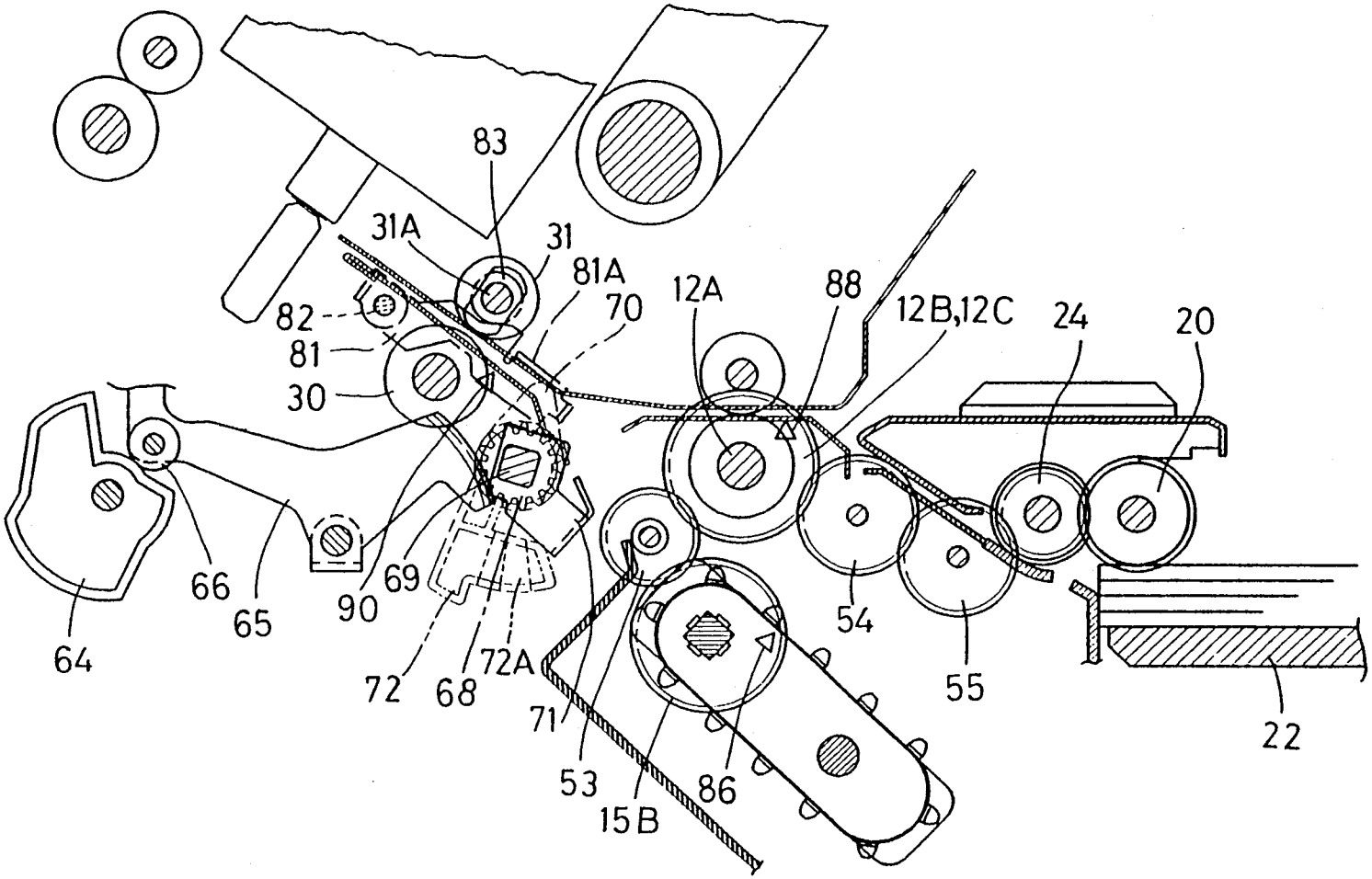
FIG. 4 is an enlarged cross-sectional view of a shutoff mechanism and a path switching mechanism at the time of printing on the continuous form.

Referring first to FIGS. 2 and 3, the printer of the present embodiment has a printing area which includes a platen 2, a carriage 7 driven by a drive motor and a timing belt (not shown) to reciprocate right and left along guide shafts 3A and 3B within the printer, and a printing head 4 secured to the carriage 7 for printing on a paper sheet placed on the platen 2. The printer is also provided with, as an arrangement for taking in printing paper sheets, a feed roll 12 and a pinch roll 13. The pinch roll 13 feeds single-sheet forms manually from a table 8 as a guide member provided at the front (toward the right side in FIG. 2) of the printer.

The single-sheet forms are inserted by an automatic paper sheet feeder 10 disposed below the table 8, and a tractor 15 takes in a continuous form from below the automatic paper sheet feeder 10 at the front of the printer. A single-sheet form feed path is provided for feeding the single-sheet forms inserted from the table 8 and the single-sheet forms taken in from the automatic paper sheet feeder 10 to the printing area. This feed path includes the feed roll 12, the pinch roll 13, a feed roll 30 and a pinch roll 31, paper guides 40, 42, 44, and a paper guide 71 serving as a path switching member. A continuous form feed path for feeding the continuous form taken in along the tractor 15 to the printing area includes the feed roll 30, the pinch roll 31, and the paper guides 42, 44, and 71.

A first single-sheet form sensor 90 for detecting the bottom end of the paper sheet is disposed below the paper guide 42. A second single-sheet form sensor 88 for detecting the presence of the paper sheet at the position of the sensor is disposed below the paper guide 40.

By the rotation of a pickup roll 20, the automatic paper sheet feeder 10 feeds the single-sheet forms stacked in a hopper 22 serving as a tray to a separation roll 24. The separation roll 24 rotates to separate the single-sheet forms one by one between the roll 24 and a pad 26, and feeds them into the printer. This is a known feeding method.

The continuous form taken in by the tractor 15 or the single-sheet form taken in by the feed roll 12 and the pinch roll 13 is held between the feed roll 30 and the pinch roll 31. The form is then fed by the rotation of the feed roll 30 into the gap between the platen 2 and a nose body 6 of the printing head 4. The continuous form or single-sheet form that passes through this printing area is held between a feed roll 32 and a pinch roll 33. The form is discharged by the rotation of the feed roll 32 onto a paper stack 35 for the single-sheet forms arranged at the rear of the printer.

The single-sheet forms can be discharged onto the paper stack 35 when they are processed continuously. They can also be discharged according to the operator's option onto the table 8 when they are processed one by one, as in the case of a billing job or the like.

As shown in FIG. 3, the feed rolls 30 and 32 are driven by a paper sheet feed drive motor 50 by a timing belt 51. The feed roll 12 for taking in the single-sheet forms is driven by the paper sheet feed drive motor 50 by a drive gear 30B provided on a rotary shaft 30A of the feed roll 30, an idle gear 52, and a drive gear 12B provided on a rotary shaft 12A of the feed roll 12.

The tractor 15 is driven by the paper sheet feed drive motor 50 by the drive gear 12B fixed on the rotary shaft 12A of the feed roll 12, an idle gear 53, and a drive gear 15B provided on a drive shaft (square shaft) 15A of the tractor 15. The pickup roll 20 and the separation roll 24 of the automatic paper sheet feeder 10 are driven by the paper sheet feed drive motor 50 by the drive gear 12B fixed on the rotary shaft 12A, the idle gear 53, an idle gear 12C, an idle gear 54, and an idle gear 55. The idle gear 12C is fit with play to be rotatable but not axially movable on the rotary shaft 12A of the feed roll 12.

Rotary shafts 20A and 24A for the pickup roll 20 and the separation roll 24 are provided with conventional switching mechanisms. The mechanisms use, for example, a one way clutch so that both the pickup roll 20 and separation roll 24 are driven by the paper sheet feed drive motor 50 when the single-sheet forms are to be separated one by one and conveyed in the form feed direction. When the single-sheet forms are to be conveyed in the direction opposite the paper sheet feed direction, the drive force of the paper sheet feed drive motor 50 is not transmitted to the rolls 20 and 24.

As will be explained more in detail later, the idle gear 53 is arranged to be movable in the direction normal to the paper surface by the paper sheet feed drive motor 50 and a cam. Thus, the transmission of the drive force of the paper sheet feed drive motor 50 to the automatic paper sheet feeder 10 and the tractor 15 can be interrupted.

As described above, with the printer of the present embodiment, the continuous form is taken in from the tractor 15 at the front of the printer and discharged onto the paper stack 35 at the rear of the printer by the rotation of the paper sheet feed motor 50. The single-sheet forms are taken in from the table 8 or the automatic paper sheet feeder 10 at the front of the printer. Then, they are discharged after printing onto the paper stack 35 at the rear of the printer or onto the table 8 at the front of the printer.

Next, the path switching mechanism of the present embodiment, the shutoff mechanism for the power transmission from the paper sheet feed motor 50 to the feed roll 12, the automatic paper sheet feeder 10, and the tractor 15 is described referring to FIGS. 1 and 4 through 9.

Figure 1:
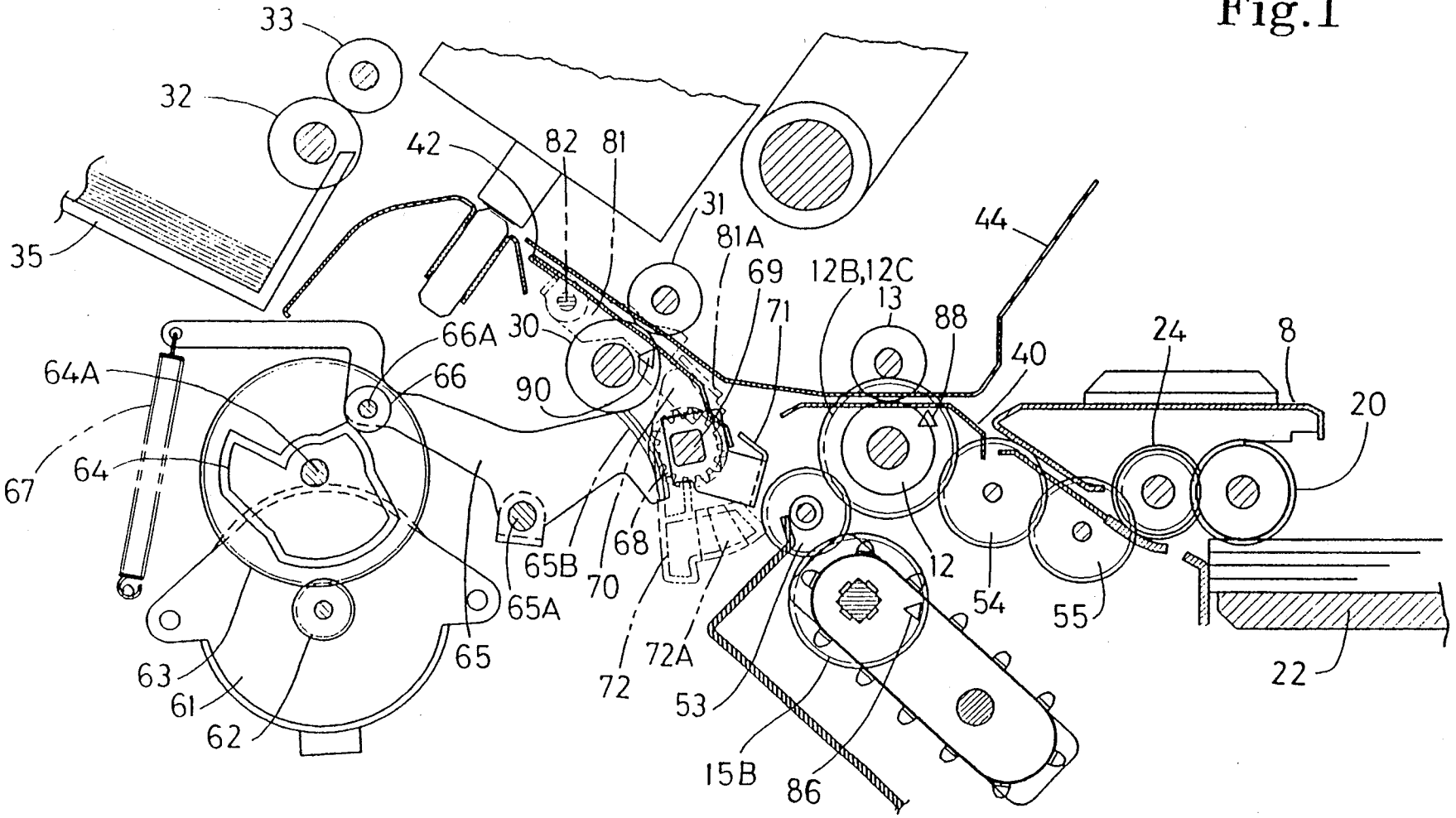
FIG. 1 is an enlarged cross-sectional view of a shutoff mechanism of power transmission and path switching mechanism at the time of continuous form feed with a printer of one embodiment of the invention.

As shown in FIG. 1, the printer includes a main cam 64 rotated by a cam drive motor 61 by drive gears 62 and 63 about a shaft 64A and a link 65 supported for rotation about a shaft 65A. A follower roll 66 is rotatably attached to the link 65 by a pin 65A and constantly brought in contact with the surface of the main cam 64 by a tension spring 67 attached to the end of the link 65 and the frame of the printer. Therefore, when the main cam 64 is rotated by the cam drive motor 61, the follower roll 66 moves along the surface of the main cam 64 so that the link 65 swings about the shaft 65A.

At the end of the link 65 opposite to the end where the tension spring 67 is attached, a gear portion 65B is formed. A drive gear 68 engages with the gear portion 65B and rotates by the swing of the link 65. The drive gear 68 is formed integrally with a first auxiliary cam 70 and is fixed on a square shaft 69. Fixed on the square shaft 69 are a paper guide 71 for selectively constituting paper sheet feed paths for single-sheet and continuous forms and a second auxiliary cam 72. The square shaft 69 is supported by right and left frames (not shown) of the printer. Therefore, the drive gear 68 and the square shaft 69 rotate along with the swing of the link 65, and the first auxiliary cam 70, the second auxiliary cam 72, and the paper guide 71 rotate as a whole. As a result, the paper guide 71 is permitted to rotate between a continuous form guiding position, shown in FIG. 4 where the continuous form can be guided toward the printing area, and single-sheet form guiding positions, shown in FIGS. 5 and 6 where the single-sheet forms only can be fed while the continuous form feed path is shut off.

Figure 7A:
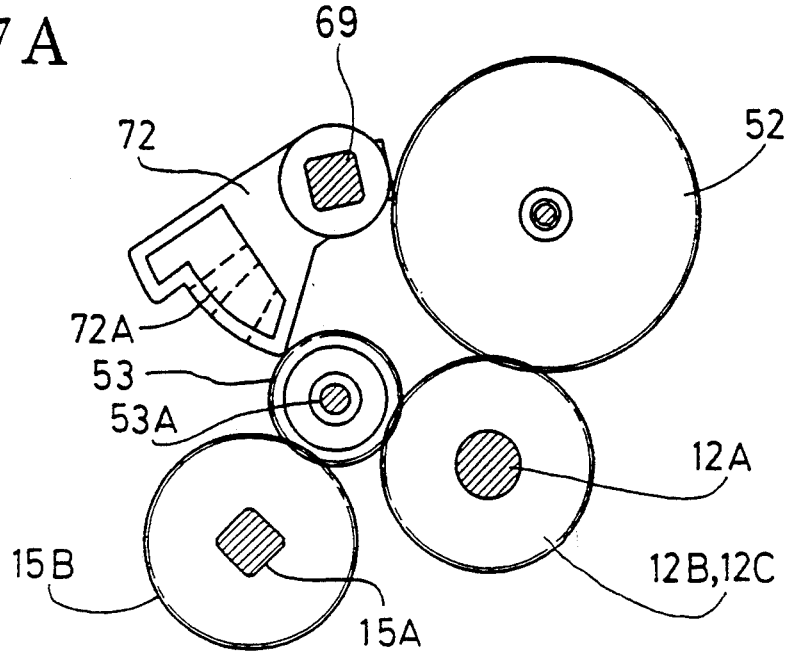
FIG. 7A is a schematic drawing explaining the shutoff mechanism at the time of feeding the continuous form in a side view.
Figure 7B:
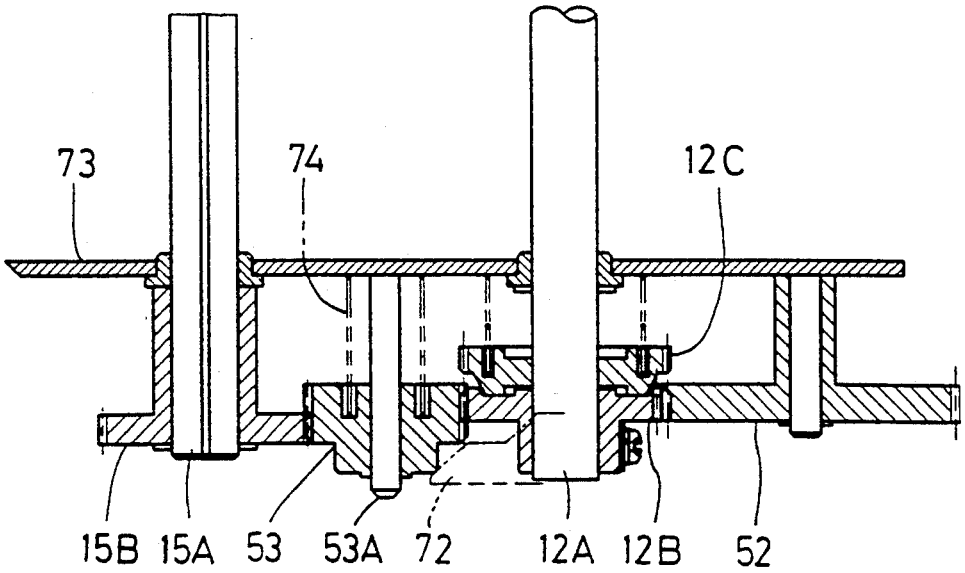
FIG. 7B is a partial sectional top view of FIG. 7A.
Figure 8A:
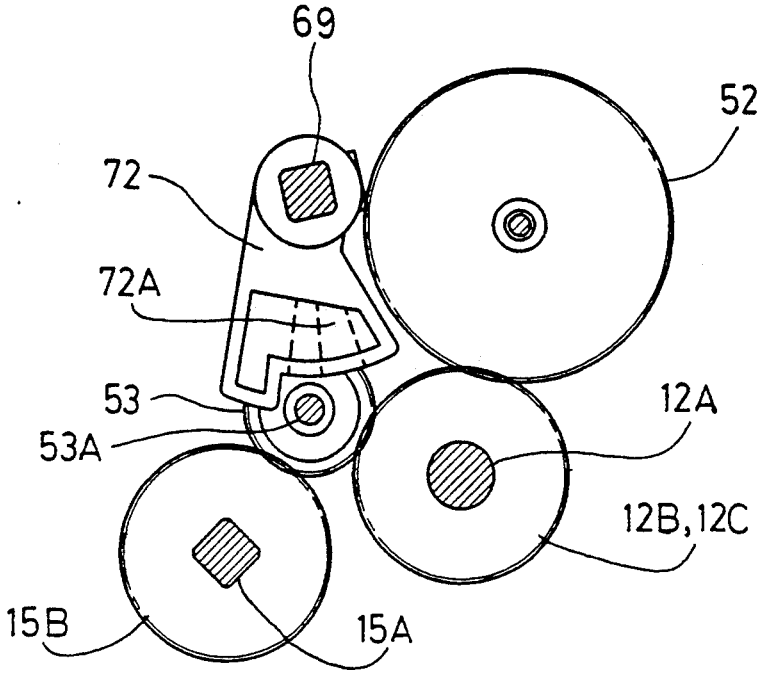
FIG. 8A is a schematic drawing for explaining the shutoff mechanism at the time of manually feeding the single-sheet forms in a side view.
Figure 8B:
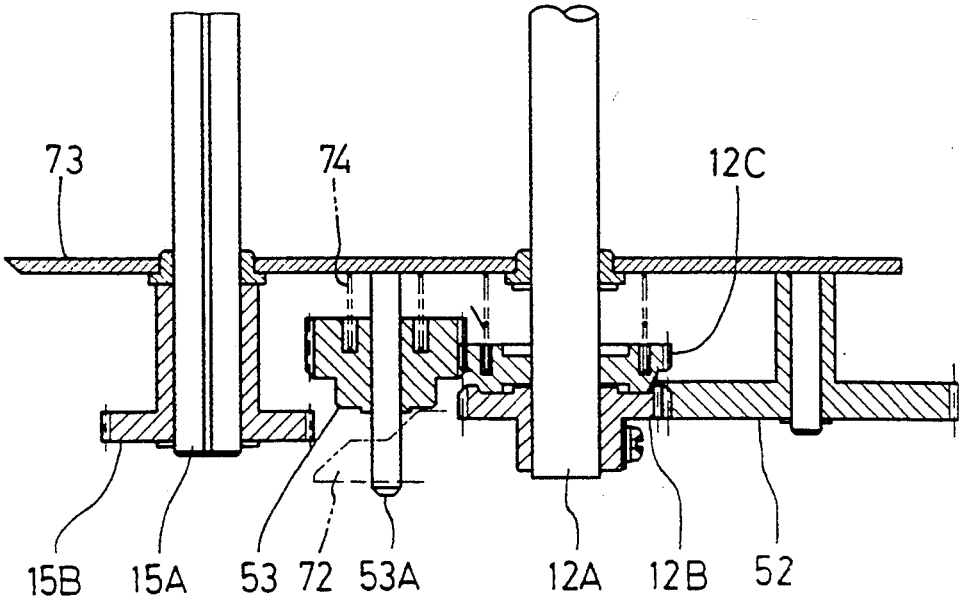
FIG. 8B is a partial sectional top view of FIG. 8A.
Figure 9A:
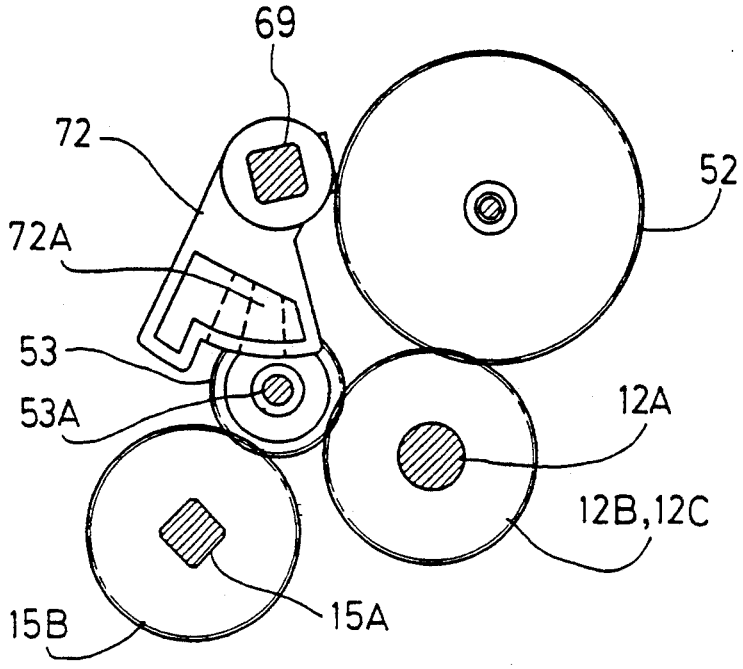
FIG. 9A is a schematic drawing for explaining the shutoff mechanism at the time of feeding the single-sheet forms from the automatic paper sheet feeder in a side view.
Figure 9B:
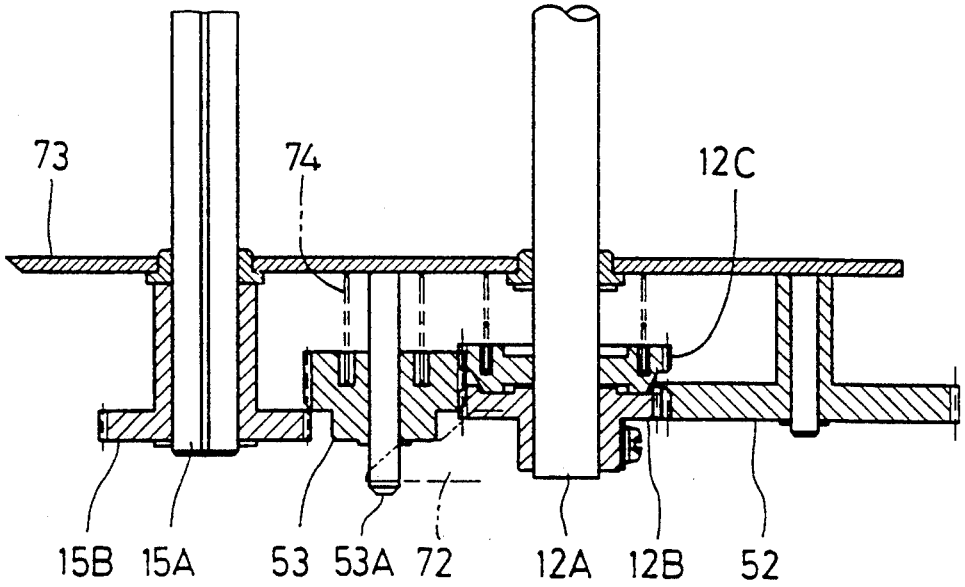
FIG. 9B is a partial sectional top view of FIG. 9A.

As shown in FIGS. 8A and 8B, the second auxiliary cam 72 is formed in a stepped shape. The idle gear 53 is arranged on the locus of the rotation of a stepped cam portion 72A of the cam 72. The idle gear 53 is supported with play to be rotatable on a shaft 53A erected on a frame 73 of the printer. A compression spring 74 (FIG. 8B) is arranged between the idle gear 53 and the frame 73 to urge the idle gear 53 in the direction away from the frame 73. As a result, the idle gear 53 comes into successive contact with the steps of the cam portion 72A according to the rotation of the second auxiliary cam 72 and moves in the axial direction of the shaft 53A. Along with the movement of the idle gear 53, the printer can be switched to the following three conditions: the condition as shown in FIG. 7A, in which power is transmitted from the drive gear 12B fixed on the rotary shaft 12A of the feed roll 12 to the drive gear 15B fixed on the square shaft 15A of the tractor 15 by the idle gear 53; the condition as shown in FIG. 9A, in which power is transmitted from the drive gear 12B fixed on the rotary shaft 12A of the feed roll 12 to the idle gear 12C for driving the automatic paper sheet feeder 10 by the idle gear 53; and the condition as shown in FIG. 8A, in which power is not transmitted to the idle gear 12C and the drive gear 15B, and only the feed roll 12 is rotated.

Figure 5:
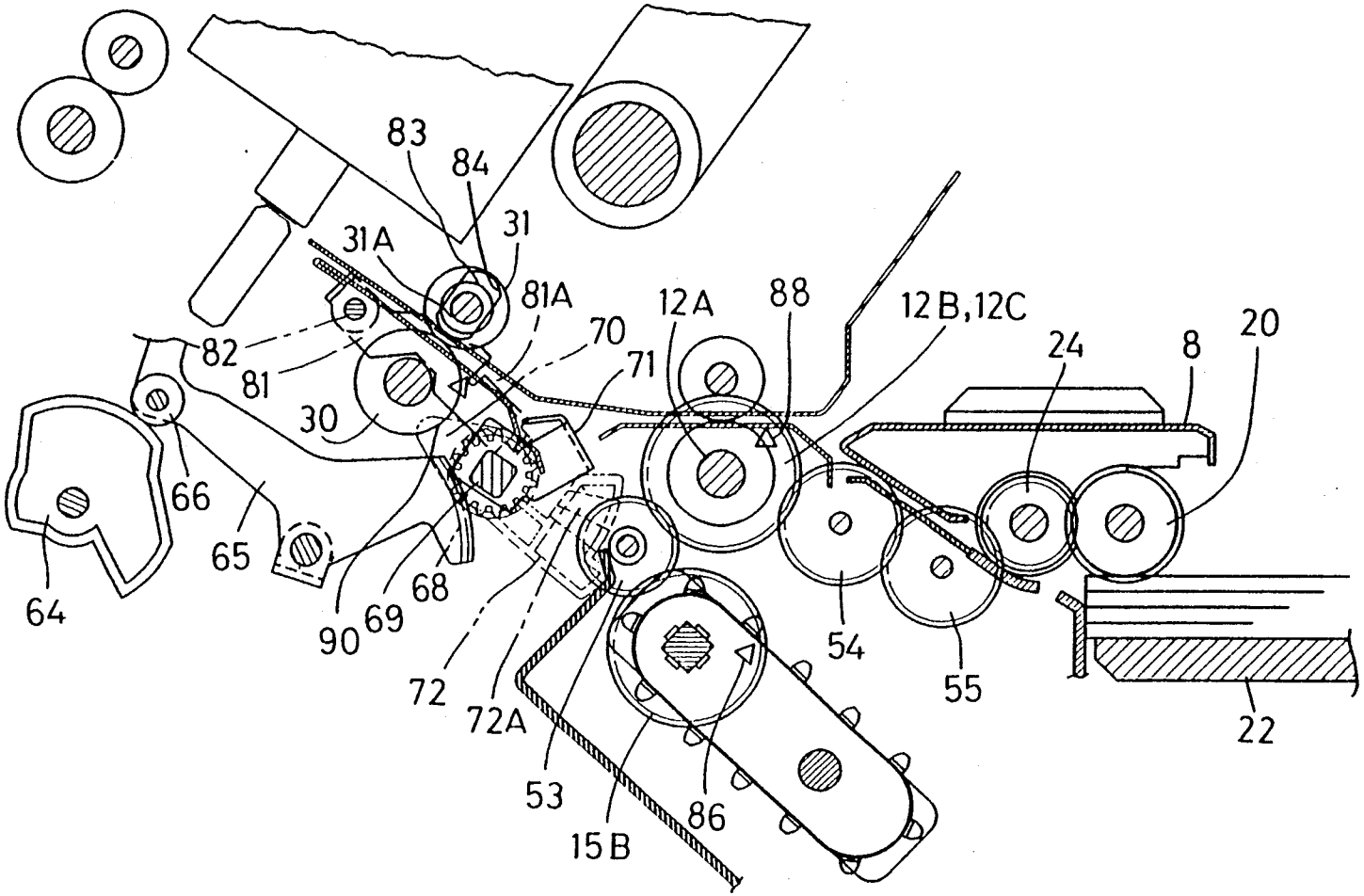
FIG. 5 is an enlarged cross-sectional view of a shutoff mechanism and a path switching mechanism at the time of inserting the single-sheet forms.

As shown in FIG. 5, a swing link 81 is fit on and supported by a shaft 82 above the first auxiliary cam 70, and the end of the swing link 81 is formed to be a contact portion 81A. Along with the rotation of the first auxiliary cam 70, the cam surface of the first auxiliary cam 70 comes into contact with the contact portion 81A so that the swing link 81 is rotated about the shaft 82. A rotary shaft 31A of the pinch roll 31 for feeding the continuous and single-sheet forms to the printing area fit on and are supported by bearings 83 on both right and left ends for rotation. The bearings 83 are in turn fit in and supported by elongated holes 84 formed in the right and left frames (not shown) of the printer. Therefore, the pinch roll 31 is permitted to move in the longitudinal direction of the elongated hole 84 so that the pinch roll 31 is capable of moving toward or away from the feed roll 30. Since the swing link 81 is in contact with the bearing 83 if the swing link 81 is swung upward, the pinch roll 31 is moved in the longitudinal direction of the elongated hole 84. Therefore, along with the rotation of the first auxiliary cam 70, the pinch roll 31 is switched to either a pressed condition or a released condition relative to the feed roll 30.

Figure 10:
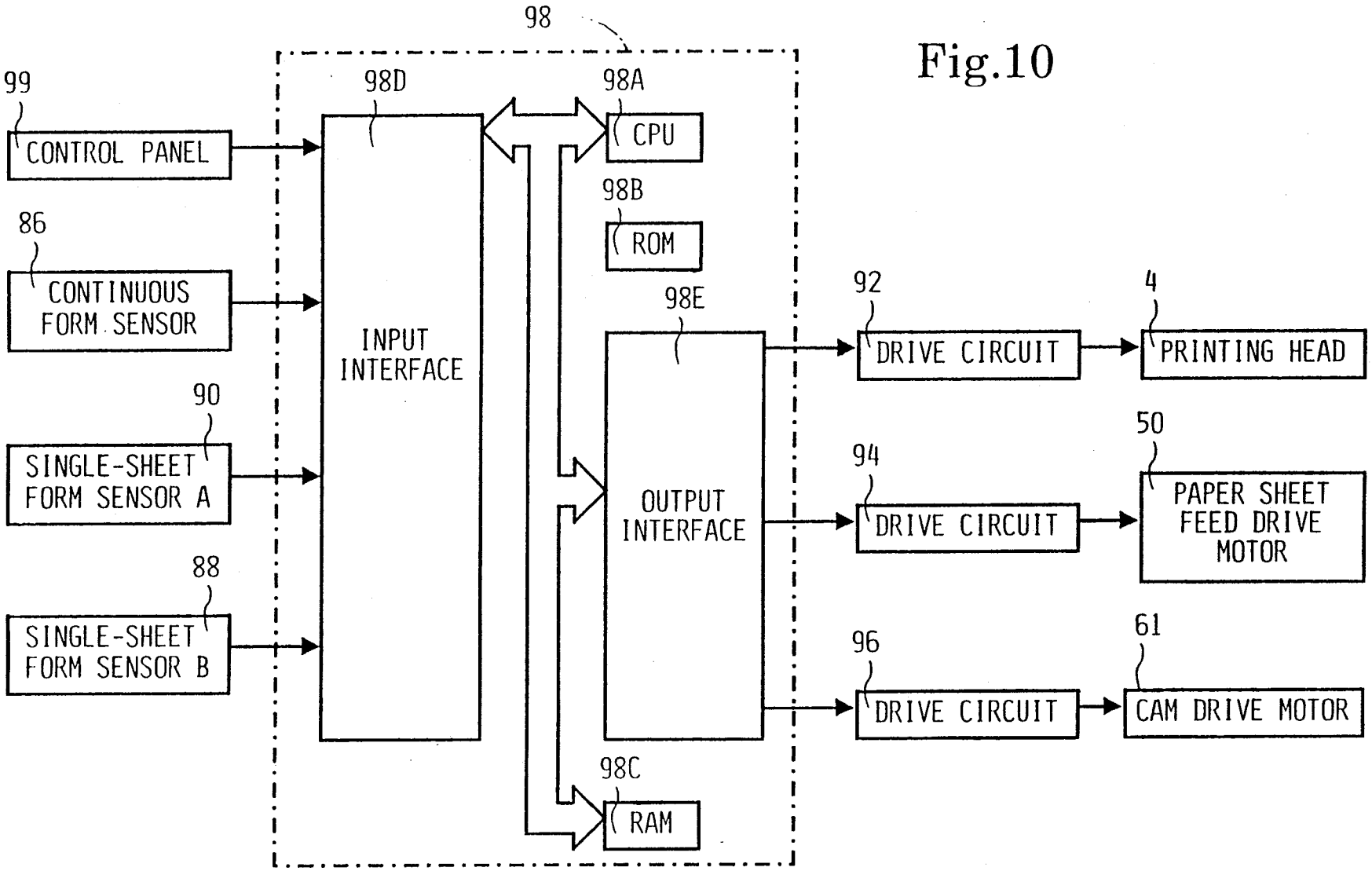
FIG. 10 is a block diagram showing the constitution of a control device for driving and controlling the printer.

As shown in FIG. 10, a control device comprises control circuits 92, 94, and 96, for respectively driving the printing head 4, the paper sheet feed drive motor 50, and the cam drive motor 61. Also, a continuous form sensor 86 for detecting the continuous form, a first single-sheet form sensor 90 for detecting the single-sheet form, and a control circuit 98 form the control device. The control circuit 98 functions as control means for outputting drive signals to the drive circuits 92, 94, 96 in response to printing data inputted from external devices and detection signals from a second single-sheet form sensor 88 to drive the printing head 4 and the drive motors 50 and 61.

The control circuit 98 comprises a microcomputer including a CPU 98A, a ROM 98B, and a RAM 98C, for receiving detected signals and printing data through an input interface 98D and outputting various drive signals through an interface 98E.

Next the control function of the printer of the present embodiment will be explained in reference to the flow charts shown in FIGS. 11A through 14.

Figure 11A:
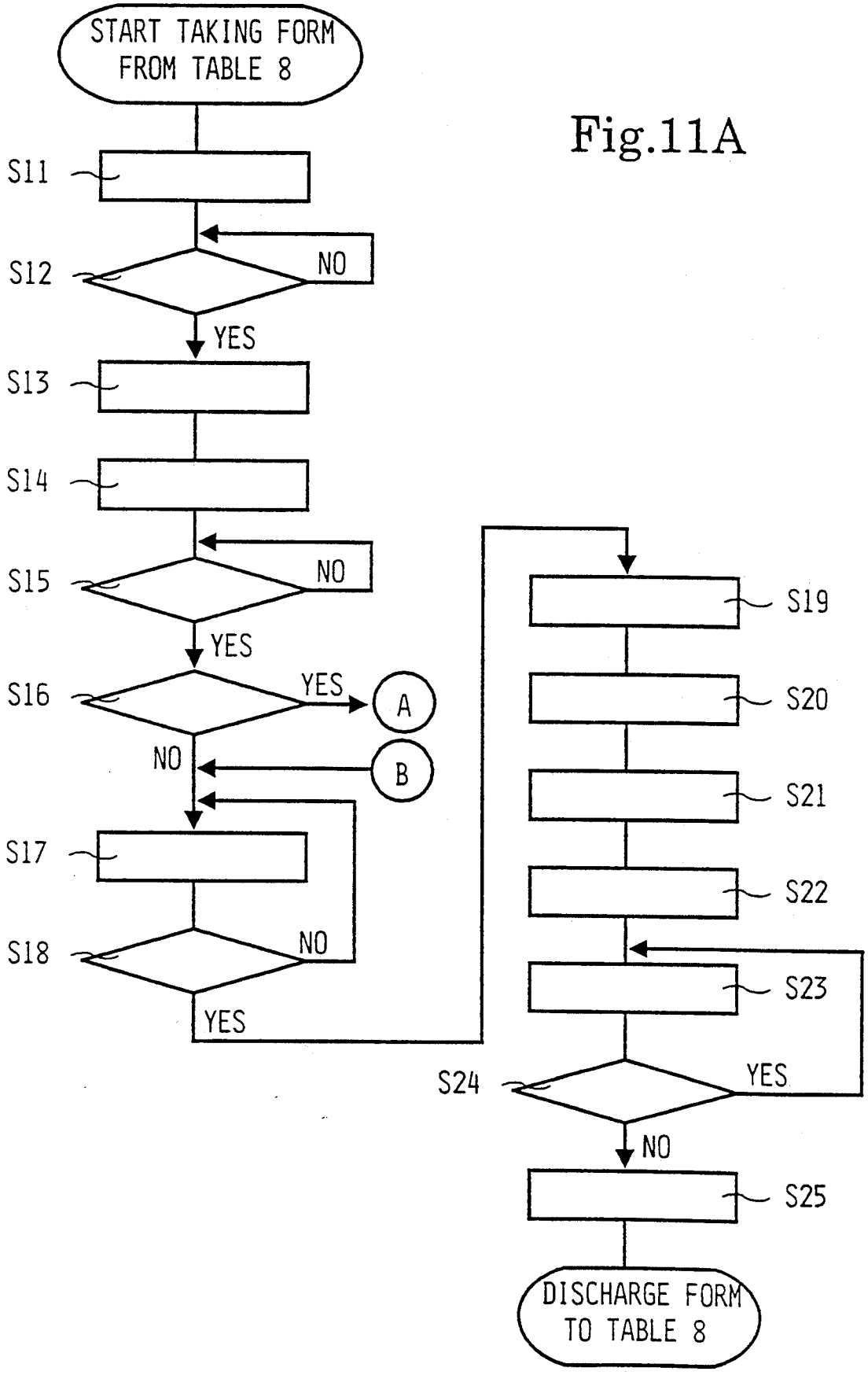
FIG. 11A is a flow chart of a control circuit when manually fed single-sheet forms are processed.
Figure 12:
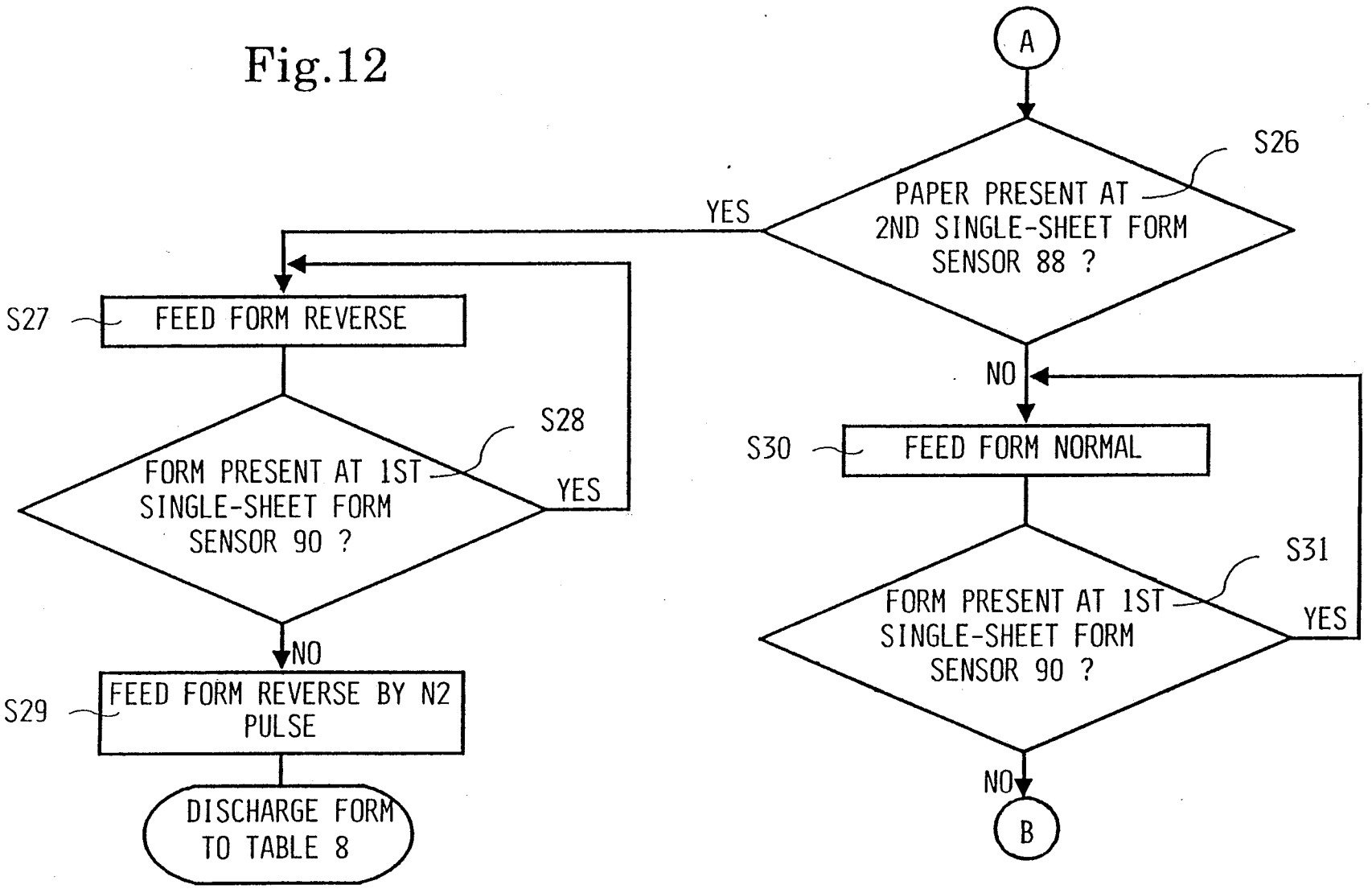
FIG. 12 is a flow chart of a control circuit when manually fed single-sheet forms are processed.
Figure 13A:
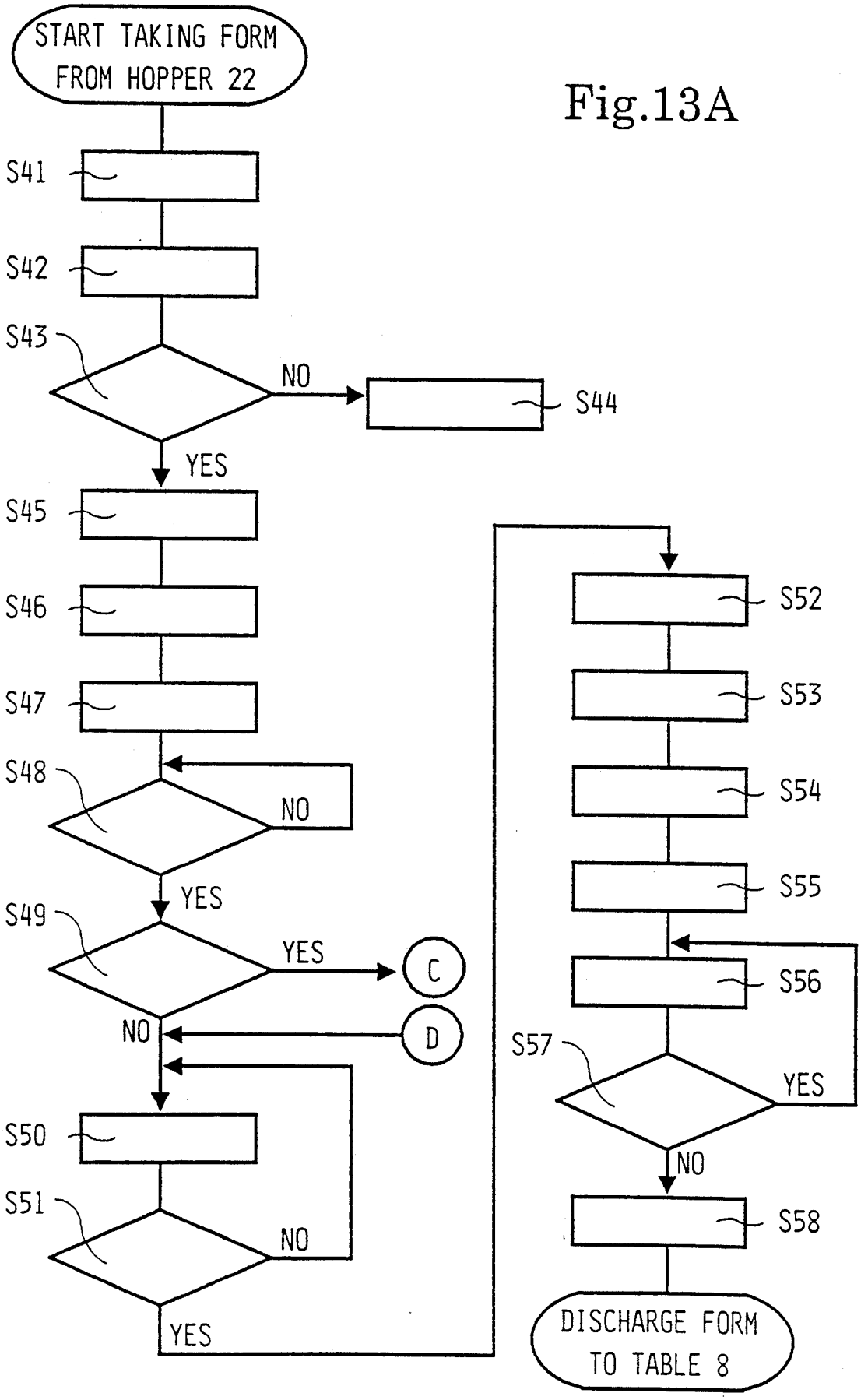
FIG. 13A is a flow chart of a control circuit when single-sheet forms fed from the automatic paper sheet feeder are processed.
Figure 14:
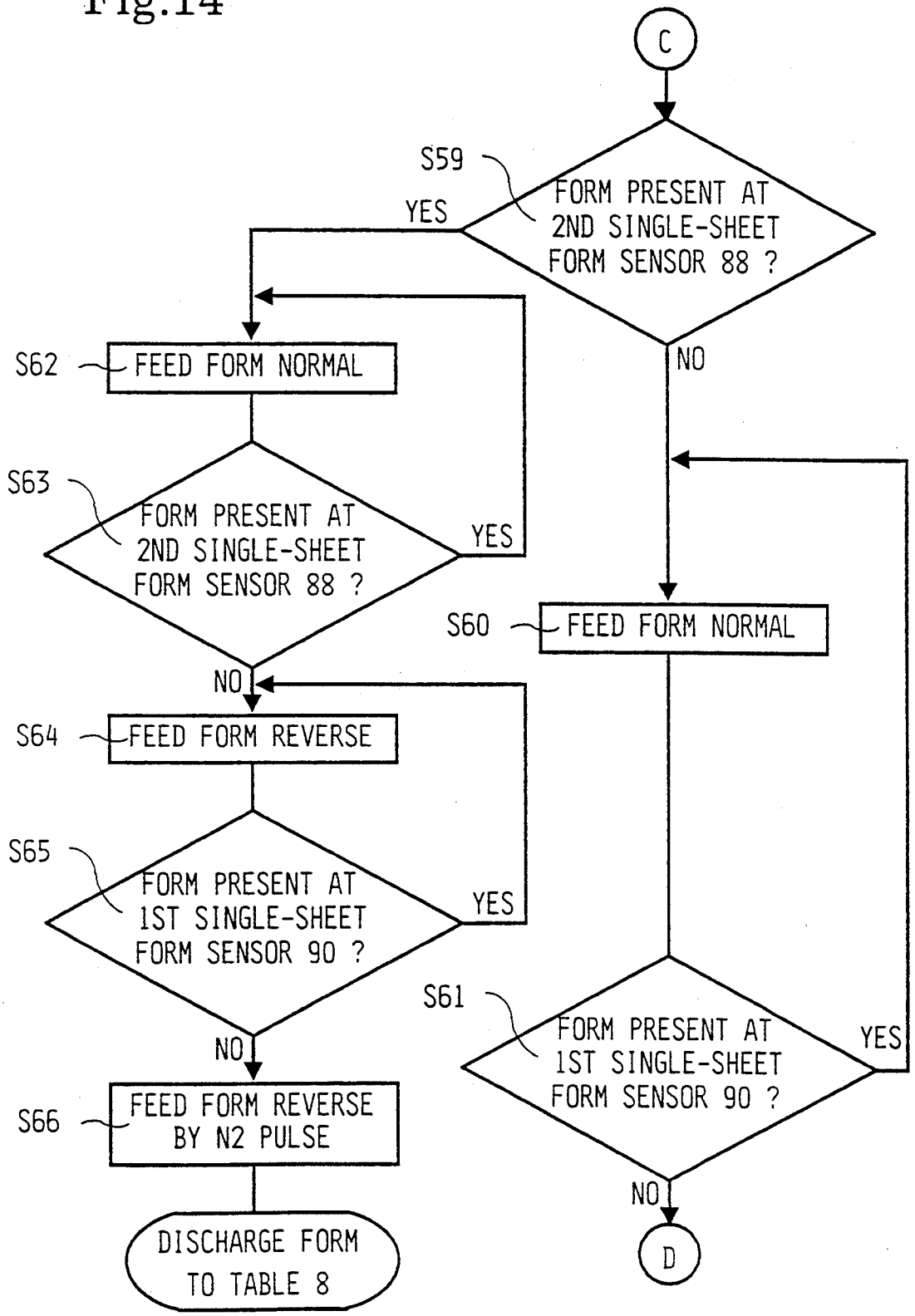
FIG. 14 is a flow chart of a control circuit when single-sheet forms fed from the automatic paper sheet feeder are processed.
Figure 15:
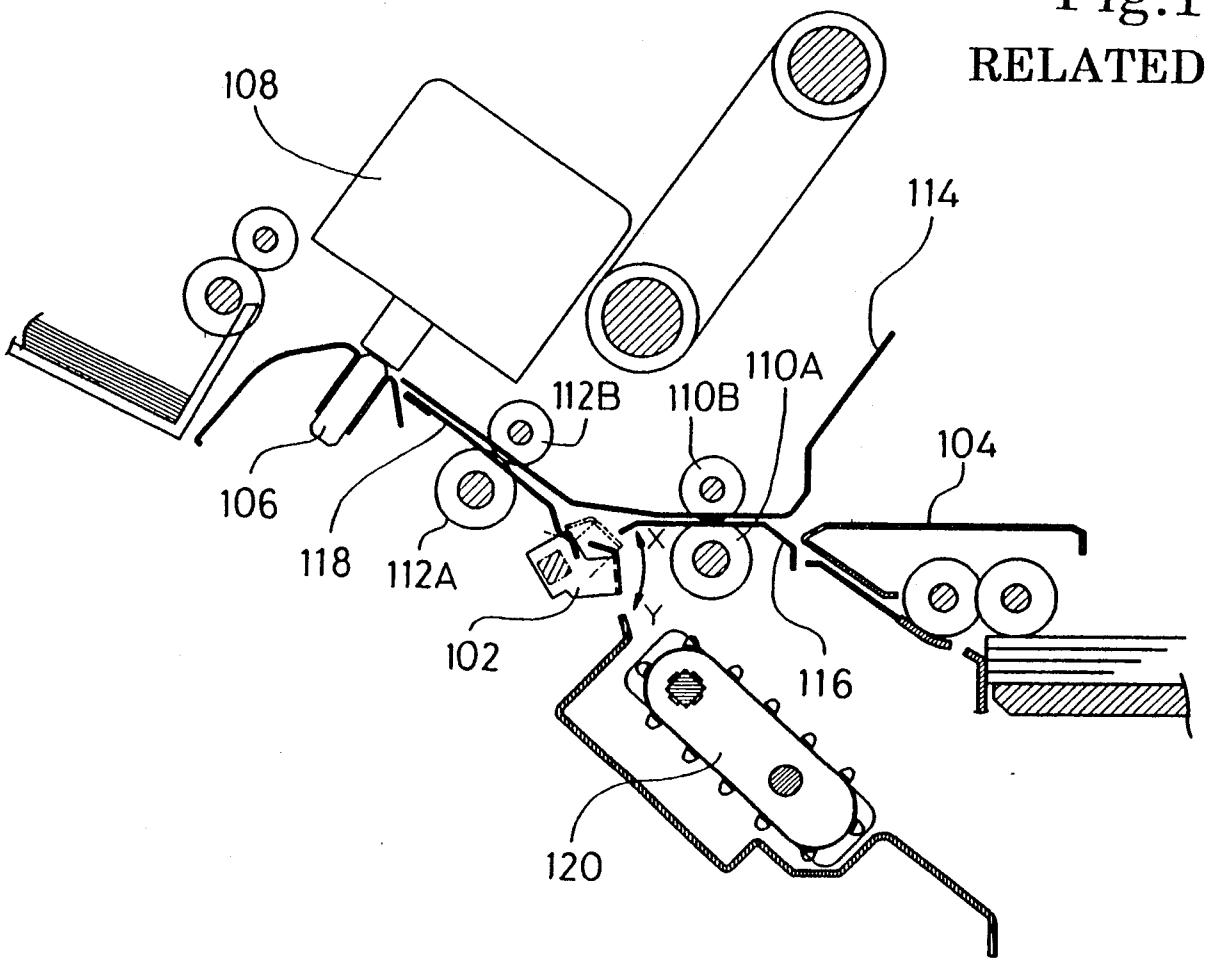
Fig.15 RELATED ART
FIG. 15 is a schematic cross-sectional view of a conventional printer.

FIGS. 11A and 12 show a control example of printing on the manually inserted single-sheet form, and FIGS. 13A and 14 show a control example of printing on the single-sheet form fed from the automatic paper sheet feeder.

In FIG. 11A, if the operator selects manual insertion of the single-sheet form on a control panel 99 and presses a take-in switch (not shown), first the control circuit 98 drives the cam drive motor 61 to bring the first auxiliary cam 70, the second auxiliary cam 72, and the paper guide 71 to respective positions shown in FIG. 5 (step 11, hereinafter referred to as S11, similarly to other steps). Namely, the paper guide 71 is moved to the position for manual insertion of the single-sheet form called the first position. Under this condition, the idle gear 53 is located by the rotation of the second auxiliary cam 72 in the position shown in FIG. 8B. The power from the paper sheet feed motor 50 is transmitted only to the drive gear 12B of the feed roll 12 and not to the automatic paper sheet feeder 10 nor to the tractor 15.

Next, the control circuit 98 repeats S12 until the second single-sheet form sensor 88 detects the front end of the single-sheet form inserted from the table 8. When the second single-sheet form sensor 88 detects the front end of the single-sheet form inserted from the table 8

(S12: Yes), the control circuit 98 drives the paper sheet feed drive motor 50 to rotate the feed rolls 12, 30, 32, and pinch rolls 13, 31, 33 and feed the form to the printing area (S13). The positioning of the front end position of the form may be controlled so that the paper sheet feed drive motor 50 is driven by a specified amount from the start of the driving. Alternatively, the paper sheet feed drive motor 50 is driven by a specified amount from the detection of the front end of the form by the first single-sheet form sensor 90.

When the form is sent to the printing area, the control circuit 98 drives the drive circuit 92 and prints on the form by means of the printing head 4 according to printing data received from an external device (S14). After finishing the printing, the control circuit 98 repeats S15 until a form discharge command comes from the external device. When the control circuit 98 receives the form discharge command from the external device (S15: Yes), the step proceeds to S16.

If the single-sheet form sensor 90 does not detect the form here (S16: No), the control circuit 98 drives the drive circuit 94 to rotate the paper sheet feed drive motor 50 in the reverse direction. The reverse feed of the form is started (S17). S17 and S18 are repeated until the first single-sheet form sensor 90 detects the tail end of the form and, when the first single-sheet form sensor 90 detects the tail end of the form (S18: Yes), the control circuit 98 causes the drive circuit 94 to stop feeding the form (S19). Here the drive circuit 98 drives the drive circuit 96 to rotate the cam drive motor 61 and to bring the first auxiliary cam 70, the second auxiliary cam 72, and the paper guide 71 respectively to positions shown in FIG. 6 (S20). Namely, the paper guide 71 is rotated to the position for feeding the form from the automatic paper sheet feeder 10 called the second position. Under this condition, the idle gear 53 is controlled to the position shown in FIG. 9B and the power of the paper sheet feed drive motor 50 is transmitted to both of the drive gear 12B and the idle gear 12C supported on the rotary shaft 12A of the feed roll 12. However, by a switching mechanism (not shown) provided on the automatic paper sheet feeder 10 described above, the power of the paper sheet feed drive motor 50 is not transmitted to the pickup roll 20 and the separation roll 24 of the automatic paper sheet feeder 10. At this time, the idle gear 53 is not in engagement with the drive gear 15B, and the tractor 15 does not rotate.

Next, the control circuit 98 drives the drive circuit 94 (corresponding to N1 pulse) until the bottom end of the single-sheet form reaches the approximate center of the paper guide 71 to rotate the paper sheet feed drive motor 50 in the reverse direction (S21). Further, the control circuit 98 drives the drive circuit 96 to rotate the cam drive motor 61 and again brings the first auxiliary cam 70, the second auxiliary cam 72, and the paper guide 71 respectively to the positions shown in FIG. 5 (S22). Under this condition, the tail end of the single-sheet form is lifted by the paper guide 71 rotated in the first position and bent toward the path formed by the paper guides 40 and 44. Therefore, since the tail end of the form is not bent forcibly in the middle of the reverse feed, the form is less likely to jam so that the tail end of the form is easily guided toward the path constituted by the paper guides 40 and 44.

The control circuit 98 further drives the drive circuit 94 to rotate the paper sheet feed drive motor 50 in the reverse direction and to resume the reverse feed of the form (S23). Under this condition, the first single-sheet form sensor 90 is constantly detecting the form (S24: Yes). If the condition changes and the first single-sheet form sensor 90 is not detecting the form, when the front end of the single-sheet form has passed by the first single-sheet form sensor 90 (S24: No), the control circuit 98 further drives the drive circuit 94 to rotate the paper sheet feed drive motor 50 in the reverse direction. The motor 50 is driven by the amount (corresponding to N2 pulse) sufficient for the front end of the single-sheet form to pass by the feed roll 12 and the pinch roll 13 (S25). As a result, the single-sheet form is discharged onto the table 8.

In S16 described above, when the first single-sheet form sensor 90 detects the form (S16: Yes), the step goes to S25 (FIG. 12).

Next the flow chart of FIG. 12 is described. When the first single-sheet form sensor 90 detects the form in the step S16 described above (S16: Yes), the control circuit 98 determines whether or not the second single-sheet form sensor 88 is detecting the form (S26). If the second single-sheet form sensor 88 is detecting the form, namely if the tail end of the printed form remains at the position of the second single-sheet form sensor 88 (S26: Yes), the control circuit 98 drives the drive circuit 94 to rotate the paper sheet feed drive motor 50 in the reverse direction and to start the reverse feed of the form (S27). Under this condition, the first single-sheet form sensor 90 is always detecting the form, and the control circuit 98 continues the reverse feed of the form until the condition changes to one under which the first single-sheet form sensor 90 is not detecting the form. When the condition changes to one under which the first single-sheet form sensor 90 is not detecting the form (S28: No), the control circuit 98 drives the drive circuit 94 to rotate the paper sheet feed drive motor 50 further by the amount corresponding to N2 pulse in the reverse direction (S29) and to discharge the form onto the table 8.

When the second single-sheet form sensor 88 is not detecting the form (S26: No), namely when the tail end of the printed form is present in the path between the first and second single-sheet form sensors 90 and 88, the control circuit 98 drives the drive circuit 94 to rotate the paper sheet feed drive motor 50 and to convey the form to the normal, form feeding direction (S30). Under this condition, the first single-sheet form sensor 90 is always detecting the form. The control circuit 98 continues the normal feed of the form until the condition changes to one under which the first single-sheet form sensor 90 is not detecting the form. When the condition changes to one under which the first single-sheet form sensor 90 is not detecting the form (S31: No), the control circuit 98 drives the drive circuit 94 to rotate the paper sheet feed drive motor 50 in the reverse direction. Control actions similar to those described above are repeated thereafter.

Next the function of discharging the single-sheet forms fed from the automatic paper sheet feeder 10 is described in reference to FIGS. 13A, 13B and 14.

Figure 6:
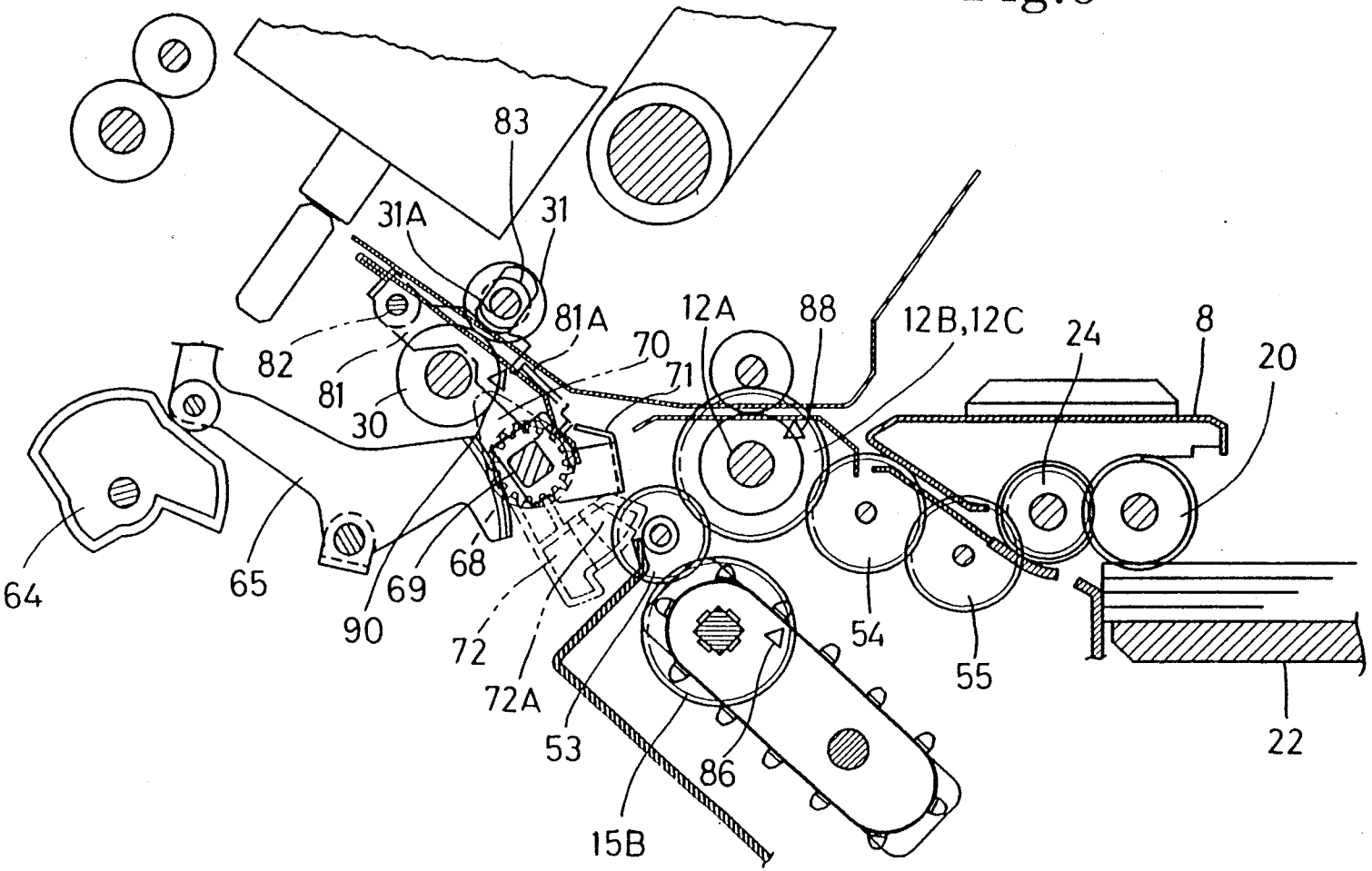
FIG. 6 is an enlarged cross-sectional view of a shutoff mechanism and a path switching mechanism at the time of feeding the single-sheet forms from an automatic feeder.

When the automatic paper sheet feeder 10 is selected on the control panel 99 and the take-in switch (not shown) is pressed, the control circuit 98 drives the drive circuit 96 to bring the first auxiliary cam 70, the second auxiliary cam 72, and the paper guide 71 respectively to the positions shown in FIG. 6 (S41). Namely, the paper guide 71 is moved to the position for feeding the form from the automatic paper sheet feeder 10 called the second position. Here, as described above, the power of the paper sheet feed drive motor 50 is not transmitted to the tractor 15.

Then the control circuit 98 drives the drive circuit 94 to rotate the paper sheet feed drive motor 50 in the normal direction by the amount corresponding to N3 pulse so that the front end of the single-sheet form taken out of a hopper 22 reaches the feed roll 12 and the pinch roll 13 (S42). Next, the control circuit 98 determines whether or not the second single-sheet form sensor 88 is detecting the form (S43). When the second single-sheet form sensor 88 is not detecting the form, namely when the front end of the single-sheet form has not reached the second single-sheet form sensor 88 (S43: No), the control circuit 98 displays a sign of error, such as paper jam on a display panel or by a display lamp, and stops the operation (S44). When the second single-sheet form sensor 88 is detecting the form (S43: Yes), the control circuit 98 drives the drive circuit 96 in a similar manner as step S11 described above to rotate the cam drive motor 61 and to bring the first and second auxiliary cams 70 and 72, and the paper guide 71 respectively to the positions shown in FIG. 5 (S45). Next, similarly to step S13, the control circuit 98 drives the paper sheet feed drive motor 50 to rotate the feed rolls 12, 30, 32, and pinch rolls 13, 31, 33 and to feed the form to the printing area (S46).

When the form is set to the printing area, similar to step S14, the control circuit 98 drives the drive circuit 92 according to printing data received from the external device to perform printing on the form by the printing head 4 (S47). After finishing printing, the control circuit 98 repeats step S48, similar to step S15, until a paper sheet discharge command comes from the external device. When the control circuit 98 receives the paper sheet discharge command from the external device (S48: Yes), the step goes to S49. Here, similar to step S16, when the first single-sheet form sensor 90 does not detect the form (S49: No), the control circuit 98, similar to step S17, drives the drive circuit 94 to rotate the paper sheet feed drive motor 50 in the reverse direction and to start the reverse feed of the form (S50). The control circuit 98 repeats steps S50 and S51 similar to steps S17 and S18, until the first single-sheet form sensor 90 detects the tail end of the form. When the first single-sheet form sensor 90 detects the tail end of the form (S51: Yes), the control circuit 98, similar to step S19, causes the drive circuit 94 to stop the paper sheet feed drive motor 50 and to stop the reverse feed of the form (S52).

Here the control circuit 98, similar to step S20, drives the drive circuit 96 to rotate the drive motor 61 and to bring the first and second auxiliary cams 70, 72, and the paper guide 71 respectively to the positions shown in FIG. 6 (S53). Namely, the paper guide 71 is moved to the position for feeding the form from the automatic paper sheet feeder 10 called the second position. Under this condition, the idle gear 53 is controlled to the position shown in FIG. 9A. While the power of the paper sheet feed drive motor 50 is transmitted to both the drive gear 12B and idle gear 12C supported on the rotary shaft 12A of the feed roll 12, the rotation of the paper sheet feed drive motor 50 is not transmitted to the pickup roll 20 and the separation roll 24 of the automatic paper sheet feeder 10 by the switching mechanism (not shown) provided on the automatic paper sheet feeder 10 as described above. At this time, the idle gear 53 is not in engagement with the drive gear 15B, and the tractor 15 does not rotate.

Next, the control circuit 98 drives the drive circuit 94, similar to step S21, until the bottom end of the form reaches the approximate center of the paper guide 71 (corresponding to N1 pulse) to rotate the paper sheet feed drive motor 50 in the reverse direction (S54). The control circuit 98, similar to step S22, drives the drive circuit 96 to rotate the cam drive motor 61 and to move the first and second auxiliary cams 70, 72, and the paper guide 71 respectively back to the positions shown in FIG. 5 (S55). Under this condition, the tail end of the single-sheet form is lifted by the paper guide 71 and bent toward the path formed by the paper guides 40 and 44. Therefore, since the tail end of the form is not bent forcibly in the middle of the reverse feed, the form is less likely to jam so that the tail end of the form is easily guided toward the path formed bY the paper guides 40 and 44.

Similar to step S23, the control circuit 98 drives the drive circuit 94 to rotate the paper sheet feed drive motor 50 in the reverse direction and to resume the reverse feed of the form (S56). Under this condition, similar to step S24, the first single-sheet form sensor 90 detects the form (S57: Yes). When the condition changes to one under which the first single-sheet form sensor 90 is not detecting the form (S57: No), namely when the front end of the single-sheet form passes bY the first single-sheet form sensor 90 (S57: No), the control circuit 98, similarly to step S25, further drives the drive circuit 94. Drive circuit 94 rotates the paper sheet feed drive motor 50 in the reverse direction by the amount (corresponding to N2 pulse) enough for the front end of the form to pass by the feed roll 12 and the pinch roll 13 (S58). As a result, the single-sheet form is discharged onto the table 8.

When the first single-sheet form sensor 90 detects the form (S49: Yes) in step S49 described above, the step goes to S59 (FIG. 14).

Referring now to FIG. 14, when the first single-sheet form sensor 90 is detecting the form in S49 described above (S49: Yes), the control circuit 98 determines whether or not the second single-sheet form sensor 88 detects the form (S59). When the second single-sheet form sensor 88 is detecting the form, namely when the bottom end of the single-sheet form is present in the feed path between the hopper 22 and the second single-sheet form sensor 88 (S59: Yes), the control circuit 98 drives the drive circuit 94 to rotate the paper sheet feed drive motor 50 in the normal direction and to convey the form in the normal, form feeding direction (S62). Here, the second single-sheet form sensor 88 is constantly detecting the form, and the control circuit 98 repeats the steps S62 and S63 until the condition changes to one under which the second single-sheet form sensor 88 is not detecting the form. When the condition changes to one under which the second single-sheet form sensor 88 is not detecting the form (S63: No), the control circuit 98, similar to S27, drives the drive circuit 94 to rotate the paper sheet feed drive motor 50 in the reverse direction and to start the reverse feed of the form (S64). Under this condition, similar to S28, the first single-sheet form sensor 90 is constantly detecting the form. The control circuit 98 continues the reverse feed of the form until the condition changes to one under which the first single-sheet form sensor 90 is not detecting the form. When the condition changes to one under which the first single-sheet form sensor 90 is not detecting the form (S65: No), the control circuit 98 drives the drive circuit 94. Drive circuit 94 rotates the paper sheet feed drive motor 50 further in the reverse direction by the amount corresponding to N2 pulse (S66) so that the form is discharged onto the table 8.

When the second single-sheet form sensor 88 is not detecting the form in S59 (S59: No), namely when the tail end of the printed form is present in the feed path between the first and second single-sheet form sensors 90 and 88, the control circuit 98 drives the drive circuit 94 to rotate the paper sheet feed drive motor 50 and to convey the form in the normal, form feeding direction (S60). Under this condition, the first single-sheet form sensor 90 is constantly detecting the form, and the control circuit 98 continues the form feed in the normal direction until the condition changes to one under which the first single-sheet form sensor 90 is not detecting the form. When the condition changes to one under which the first single-sheet form sensor 90 is not detecting the form (S61: No), the step goes to S50. The control circuit 98 drives the drive circuit 94 to rotate the paper sheet feed drive motor 50 in the reverse direction. Control actions similar to those described above are repeated thereafter.

It is to be understood that the present invention is not limited to the embodiment described in detail above and that various modifications may be made to the embodiment without departing from the spirit of the invention.

For instance, if the position of the paper guide 71 forming the continuous form feed path (the position shown in FIG. 6) is the same as the position for feeding the form from the automatic paper sheet feeder 10, a stepped portion for disengaging the idle gear 53 from the drive gear 15B may be provided. The stepped portion is on the stepped cam portion 72A of the auxiliary cam 72 at a position nearer to the front end than the position where the idle gear 53 comes in contact with the stepped cam portion 72A at the time of manual feed of the single-sheet forms. That position may be designated as the position up to which the paper guide 71 is to be moved to form the continuous form feed path.

In the present embodiment the mechanism for connecting and disconnecting the power of the paper sheet feed drive motor 50 is integral with the form feed means. However, the power connecting and disconnecting mechanism and the form feed path switching mechanism may be driven by separate drive sources.

While in the present embodiment, two, first and second single-sheet form sensors 92 and 88 are used, it is also possible to embody the present invention with a single sensor. In that case, at first the bottom end of the form is detected by the sensor. Similar control may be performed by counting the drive pulses of the paper sheet feed drive motor 50 by the CPU 98A.

As seen from the description above, to feed the forms with the printer of the present invention, the paper guide is rotated to form either the single-sheet form feed path or the continuous form feed path. When the printed single-sheet form is fed back to the position where the form is inserted, the bottom end of the form is detected. Then, the form feed is stopped for a moment, and the paper guide is rotated in the direction of the continuous form feed path. The reverse feed of the form is resumed and continued until the tail end of the form reaches the approximate center of the paper guide where the form feed is stopped. The paper guide is rotated again toward the single-sheet form feed path. After the tail end of the form is bent toward the discharge path on the downstream side of the printing area in this way, the form is fed back to its inserted position. Since control means is provided to perform the sequence described above, stabilized single-sheet form feed is made possible without causing the forms to jam.

While advantageous embodiments have been chosen to illustrate the invention, it will be understood by those skilled in the art that various changes and modifications can be made therein without departing from the scope of the invention as defined in the appended claims.

What is claimed is:

1. A printer that prints on single-sheet forms and a continuous form and is capable of discharging the printed single-sheet forms back to an input position, comprising:

a printing area;

a feed path leading to the printing area comprising a single-sheet feed path for feeding single-sheets to the printing area and a continuous sheet feed path for feeding a continuous sheet to the printing area, the continuous sheet feed path joining the single-sheet feed path at a joining area;

a feeding mechanism coupled to the single-sheet feed path and the continuous sheet feed path that selectively feeds single-sheets and a continuous sheet to and from the printing area;

a path switch disposed in the joining area of the feed path and movable between at least a first position and a second position in the feed path; and a controller coupled to the feeding mechanism controlling forward and reverse driving of the feeding mechanism and coupled to the path switch controlling movement of the path switch between the first position and the second position, said controller delaying driving of the feeding mechanism and moving the path switch into the first position when a sheet is located adjacent the path switch during discharge.

2. The printer of claim 1, further comprising a sensing assembly coupled to the feed path that senses a sheet in the feed path, and wherein when a leading end of a sheet is detected by the sensing assembly near the path switch, the controller controls the feeding mechanism to drive a sheet a predetermined amount from the sensing assembly toward the path switch and then controls the path switch to move to the first position to guide sheet toward the single-sheet feed path.

3. The printer of claim 2, wherein the controller controls the feeding mechanism to feed a single-sheet upstream and downstream the feed path based on signals from the sensing assembly.

4. The printer of claim 1, wherein the feeding mechanism comprises an input feed disposed at a single-sheet feed input in the single-sheet feed path and a print feed disposed downstream of the input feed and adjacent the printing area in the feed path.

5. The printer of claim 4, further comprising a sensing assembly coupled to the feed path comprising a first sensor adjacent the input feed and a second sensor adjacent the print feed.

6. The printer of claim 5, wherein the path switch is disposed between the first sensor and the second sensor.

7. The printer of claim 1, wherein the single-sheet feed path comprises a manual single-sheet input and an automatic single-sheet input, and the continuous sheet feed path comprises a continuous sheet feed input.

8. The printer of claim 7, wherein the feeding mechanism is selectively coupled to the automatic single-sheet feed input and the continuous sheet feed input, and the selective coupling is controlled by the controller.

9. The printer of claim 7, wherein the first position of the path switch is located in the single-sheet feed path fed by the manual single-sheet input.

10. The printer of claim 7, wherein the second position of the path switch is located in the single-sheet feed path fed by the automatic single-sheet input.

11. The printer of claim 1, wherein the first position of the path switch is located in the single-sheet feed path.

12. The printer of claim 1, wherein the path switch is further movable to a third position located in the continuous sheet feed path.

13. The printer of claim 1, further comprising a single-sheet input, wherein the controller controls the feeding mechanism to discharge a printed single-sheet at the input.

14. A reproduction apparatus, comprising:

inputting means for inputting a printing medium;

printing means for printing on the printing medium;

guide means for guiding the printing medium between the inputting means and the printing means, the guide means including an angled portion between the input means and the printing means;

switch means for switching between a first guide position and a second guide position and being located in the guide means adjacent the angled portion;

feeding means for feeding the printing medium through the guide means coupled to the guide means; and control means for controlling the switch means and the feeding means coupled to the switch means and the feeding means, wherein during discharge of the printing medium, the control means controls the feeding means to feed the printing medium from the printing means toward the switch means, and when a leading end of the printing medium reaches the switch means, the control means controls the switch means to move from the second guide position to the first guide position to guide the leading end of the printing medium to the inputting means.

15. The reproduction apparatus of claim 14, wherein said guide means includes a first path for guiding single-sheets to the printing means and a second path for guiding a continuous sheet to the printing means, and the switch means is located in the first path in the first position.

16. The reproduction apparatus of claim 14, wherein the switch means includes a third guide position for switching the feed path to the printing means.

17. The reproduction apparatus of claim 14, further comprising a sheet detector coupled to the control means and disposed in the guide means that detects printing medium.

18. The reproduction apparatus of claim 17, wherein the sheet detector comprises a first sensor adjacent the inputting means and a second sensor adjacent the printing means, the switch means is disposed between the first sensor and the second sensor.

19. The reproduction apparatus of claim 17, wherein the control means controls the feeding means to feed printing medium upstream and downstream the guide means and to move the switch means between the first and second positions based on signals from the sheet detector.

20. The reproduction apparatus of claim 14, wherein the inputting means comprises a manual single-sheet form input and an automatic single-sheet form input.

21. The reproduction apparatus of claim 14, wherein:

in the first guide position, the switch means is located in path aligned with the single-sheet form input; and in the second guide position, the switch means is in a path aligned with the automatic single-sheet form input.

22. The reproduction apparatus of claim 14, wherein the inputting means comprises a single-sheet form input, and the control means controls the feeding means to discharge a printed single-sheet form at the inputting means.

23. A method of controlling feeding of a sheet through a feed path of a reproduction apparatus having at least two feed path portions and a path switch that switches between the feed path portions, comprising the steps of:

feeding a sheet to a printing area for printing through a first feed path portion;

printing an image on the sheet in the printing area;

moving the path switch into a second feed path portion;

reversely feeding the sheet through the first feed path portion to a position adjacent the path switch;

moving the path switch into the first feed path portion to bend an end of the sheet into the first feed path portion; and commencing reverse feed of the sheet through the first feed path portion to a discharge position.

24. The method of claim 23, further comprising the step of detecting the sheet in the feed path prior to moving the path switch.

25. The method of claim 23, further comprising the step of pausing the reverse feed of the sheet when the sheet reaches the position adjacent the path switch and before the path switch is moved into the first feed path portion.

26. The method of claim 23, wherein the steps of moving the path switch includes rotating the path switch.

* * * * *